US006289597B1

(12) United States Patent
Beyers

(10) Patent No.: US 6,289,597 B1
(45) Date of Patent: Sep. 18, 2001

(54) CHALK BOX

(75) Inventor: Gregory L. Beyers, 2215 W. 3rd, Lot 336, Bloomington, IN (US) 47401

(73) Assignee: Gregory L. Beyers, Bloomington, IN (US)

( * ) Notice: Subject to any disclaimer, the term of this patent is extended or adjusted under 35 U.S.C. 154(b) by 0 days.

(21) Appl. No.: 09/434,898

(22) Filed: Nov. 5, 1999

(51) Int. Cl.[7] ..... B44D 3/38
(52) U.S. Cl. ..... 33/414
(58) Field of Search ..... 33/414, 413, 755, 33/756, 760

(56) References Cited

U.S. PATENT DOCUMENTS

| | | | |
|---|---|---|---|
| 627,057 | 6/1899 | Gavin . | |
| 648,044 | 4/1900 | Miller . | |
| 754,827 | 3/1904 | Thompson . | |
| 845,401 | 2/1907 | Field . | |
| 1,168,851 | 1/1916 | Carter . | |
| 1,219,473 | 3/1917 | Meldrum . | |
| 1,566,647 | 12/1925 | Bryan . | |
| 3,206,855 | 9/1965 | Fletcher . | |
| 3,438,595 | 4/1969 | Brown et al. . | |
| 3,475,822 | 11/1969 | De Lain . | |
| 4,272,036 | 6/1981 | Watermann . | |
| 4,438,538 * | 3/1984 | Larsen | 33/414 |
| 4,565,011 | 1/1986 | Karger | 33/414 |
| 5,042,159 | 8/1991 | Millen | 33/414 |
| 5,212,875 | 5/1993 | Corso | 33/414 |
| 5,444,919 | 8/1995 | Alves | 33/414 |
| 5,493,787 | 2/1996 | Owens | 33/414 |
| 5,644,852 | 7/1997 | Fuller et al. | 33/414 |
| 5,683,055 | 11/1997 | Dufour | 33/414 |
| 5,822,874 | 10/1998 | Nemes | 33/414 |
| 6,158,138 * | 12/2000 | Katz | 33/760 |

* cited by examiner

*Primary Examiner*—Christopher W. Fulton
(74) *Attorney, Agent, or Firm*—Woodard, Emhardt, Naughton, Moriarty & McNett

(57) ABSTRACT

A chalk box for producing a chalk line without leakage of chalk dust from within. The chalk box has a chalk-filled chamber that houses a spool and a flexible chalk line. The chalk line extends outwardly around a guidepost and through a fibrous tube. The fibrous tube snugly hugs the flexible line, preventing chalk dust from leaking through the tube. The chalk dust impregnating the flexible line provides lubrication for its passage through the fibrous tube. The present invention also includes a built-in pencil sharpener isolated from the chalk dust, for the convenience of the user.

12 Claims, 7 Drawing Sheets

CHALK BOX

TECHNICAL FIELD OF THE INVENTION

The present invention relates generally to the field of measurement tools, and more specifically to a device for producing a chalk line on a rough surface, such as at a construction site. The chalk box contains a loose chalk dust and a retractable line capable of being extended while chalked and marking a chalk line when snapped.

BACKGROUND OF THE INVENTION

Chalk boxes are well known in the construction field and have long been used to mark construction lines. The chalk preferred for use as the marking medium is brightly colored and indelible, leaving a readily visible and enduring chalk line not easily obscured by the heavy foot traffic inherent at a construction site. One persisting problem with known chalk boxes is their tendency to leak chalk dust, both when the line is extended during use and also during carrying between uses. Chalk dust leakage is a problem for several reasons. One such reason is that indelible chalk dust produces a brightly colored stain that is difficult to remove from clothing and/or other surfaces that are not desired to be marked. Finely powdered chalk dust tends to have almost-liquid flow characteristics, and thus even if the chalk box is carried in a pocket, the leaked chalk dust does not long remain confined. Further, as construction technology progresses, increasingly complex and delicate electronic tools, equipment, and measurement devices are becoming commonplace at the work site. These tools, such as computers, laser measurement devices, ultrasonic probes, and the like are all susceptible to damage from dust contamination. While care is taken to protect them from airborne dust intrusion, accidental direct introduction of chalk dust from the clothing or hands of an operator could cause expensive and time-consuming equipment damage. Moreover, leaked chalk dust staining the work site can obscure or confuse the intentionally laid chalk lines, again resulting in the need for repeated measurements and other costly delays, decreasing productivity at the work site. Finally, chalk dust leakage necessitates more frequent replacement of the chalk dust in the chalk box, again decreasing efficiency and productivity.

Typically, the worker using the chalk box also makes other measurement markings at the construction site. Some of these markings involve using regular or colored pencils. When these pencils become dull, the worker typically uses a knife or utility blade to crudely sharpen them, a process that is inefficient and wasteful in that useful pencil is typically shaved off along with the wood. Since workers must carry their equipment with them, most find it inconvenient to carry a small, loose pencil sharpener when they already have a knife. Providing a pencil sharpener that does not add to the number of tools the worker must carry would therefore increase efficiency and enhance productivity.

At the work site, productivity is one of the keys to remaining competitive and making a profit. Tools that decrease work site delays and increase efficiency and productivity therefore help to increase profit. Therefore, a need arises for a chalk box that minimizes chalk dust leakage. There is a further need for providing a pencil sharpener that does not further encumber the worker. The present invention satisfies these needs.

SUMMARY OF THE INVENTION

The present invention relates to a chalk box for producing a chalk line that decreases the amount of chalk dust leakage common to known chalk boxes. In one embodiment, a narrow exit tube is formed through which the chalk line exits the chalk box. The tube is surrounded by a fibrous material and is formed just wide enough for the line to pass through. The passage of the line through the tube is facilitated by the lubrication effect of the chalk powder impregnating the line. A built-in pencil sharpener is also provided for the convenience of the user.

One object of the present invention is to provide an improved chalk box. Related objects and advantages of the present invention will be apparent from the following description.

DETAILED DESCRIPTION OF THE PREFERRED EMBODIMENT

Figure 1:
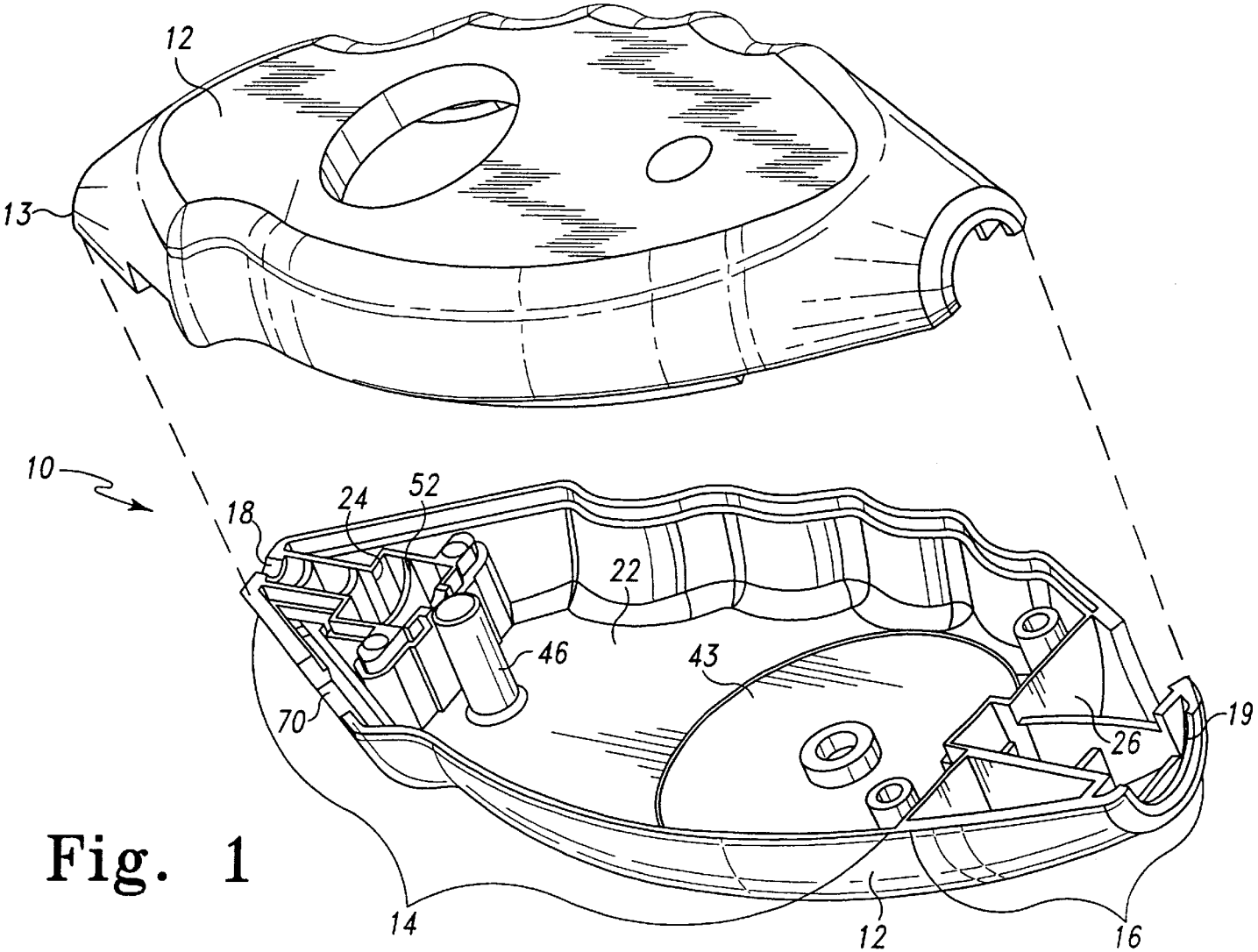
FIG. 1 is a top exploded partial perspective view of the interior of the preferred embodiment of the present invention.
Figure 2:
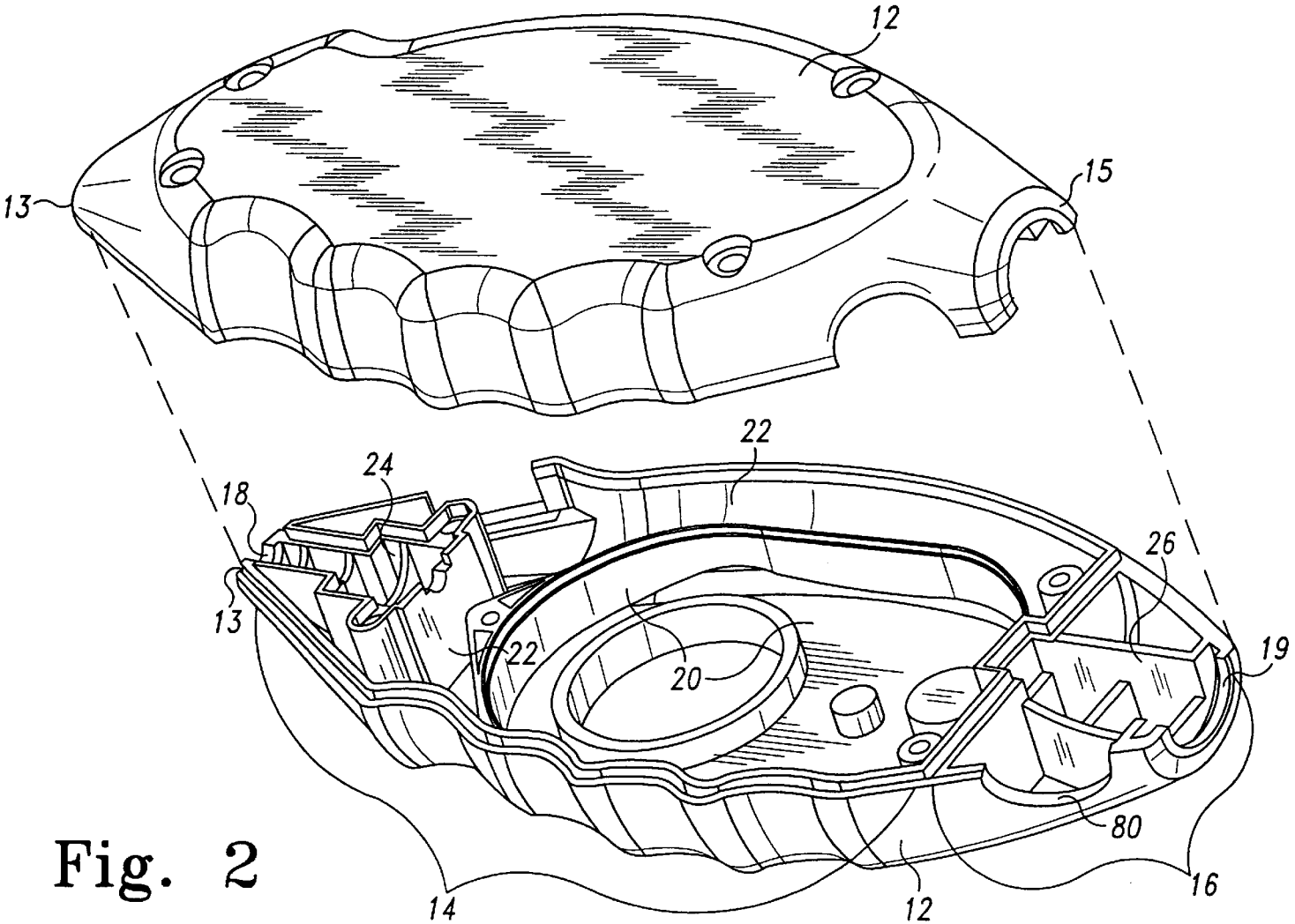
FIG. 2 is bottom exploded partial perspective view of the embodiment of FIG. 1, showing the empty gear chamber within the housing.
Figure 3A:
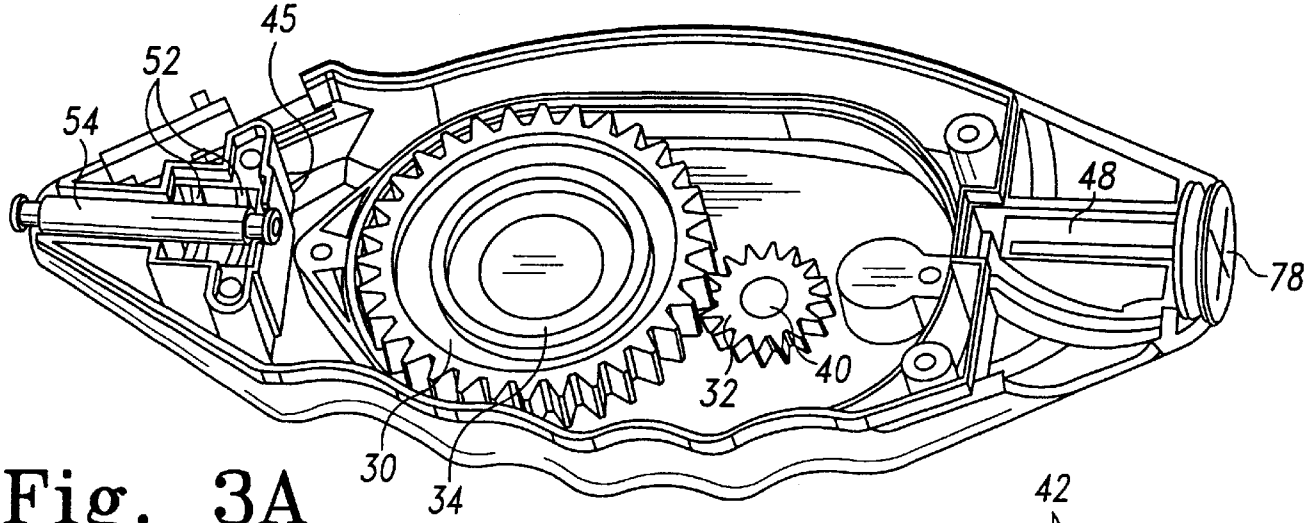
FIG. 3*a* is another bottom partial perspective view of FIG. 2, showing the gears in the gear chamber.
Figure 3B:
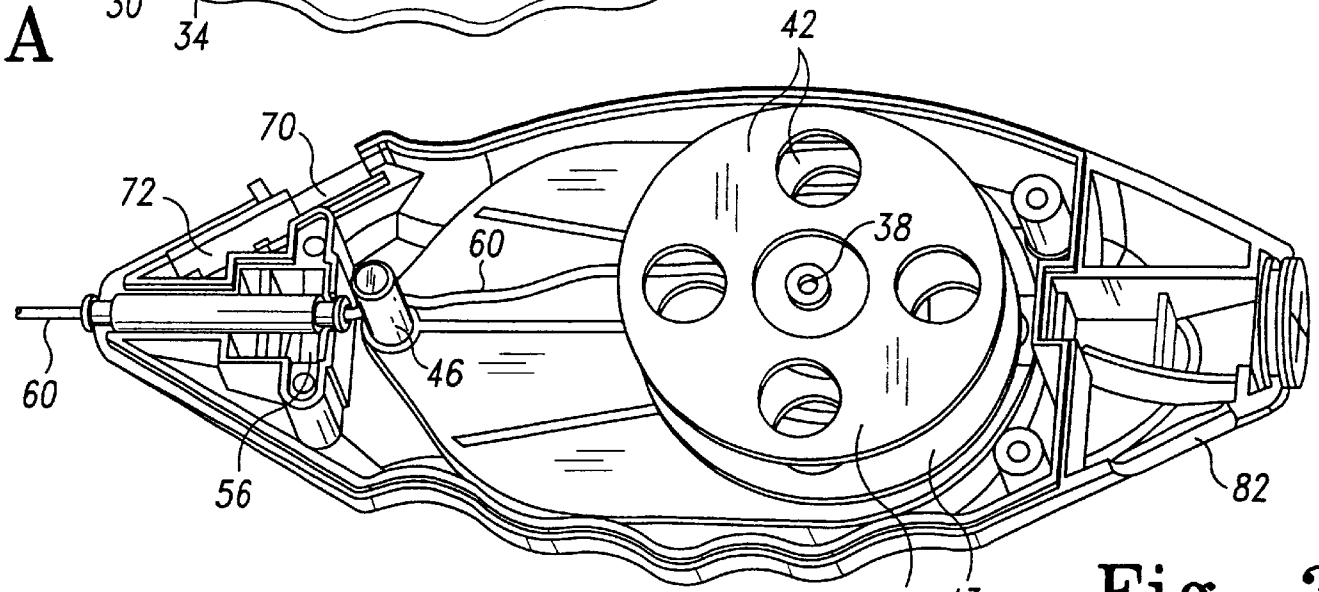
FIG. 3*b* is yet another bottom partial perspective view of FIG. 2, showing the spool connected to the enclosed gear chamber.
Figure 4A:
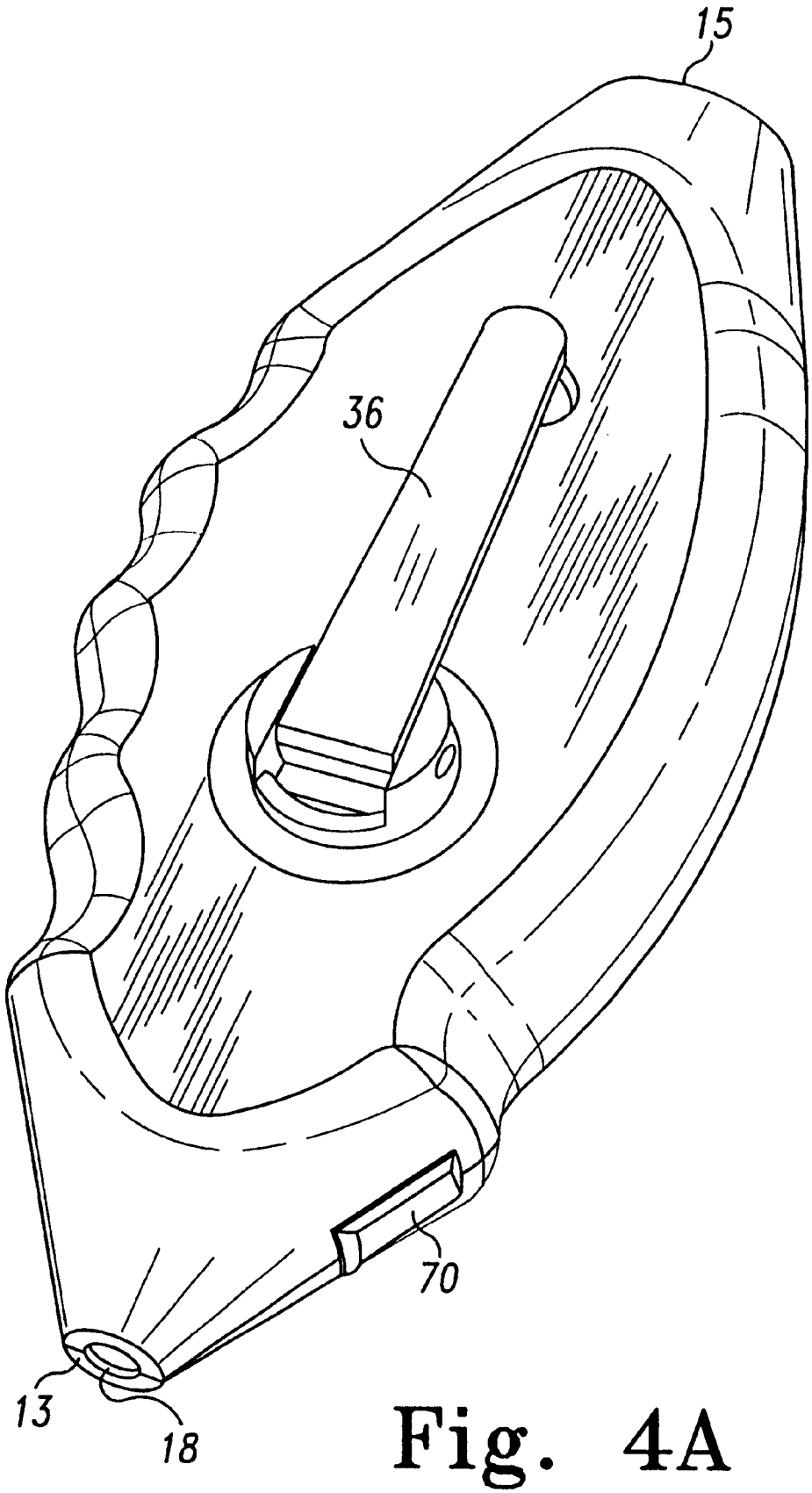
FIG. 4*a* is a top perspective view of the embodiment of FIG. 1.
Figure 4B:
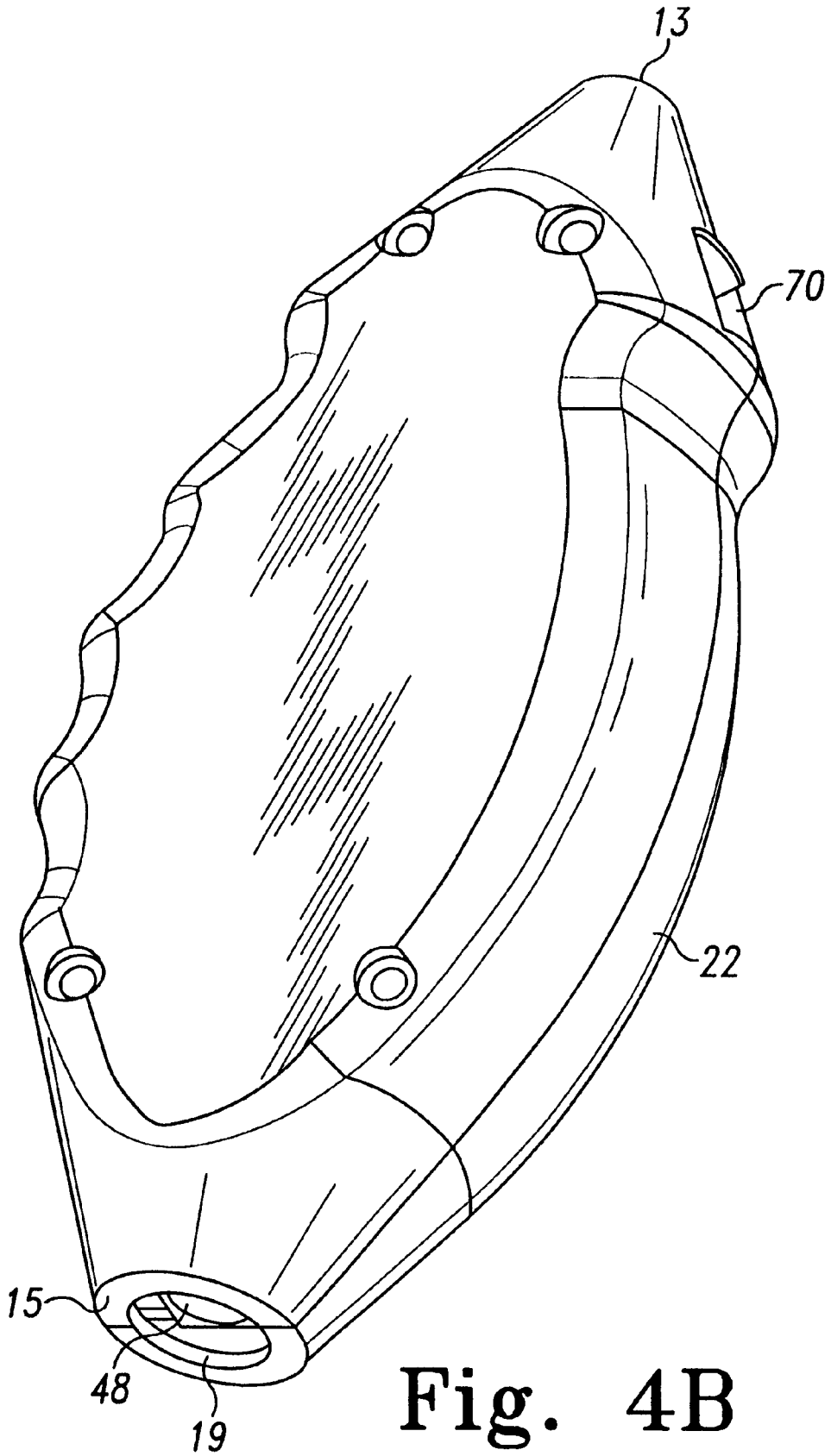
FIG. 4*b* is a bottom perspective view of the embodiment of FIG. 1.
Figure 4C:
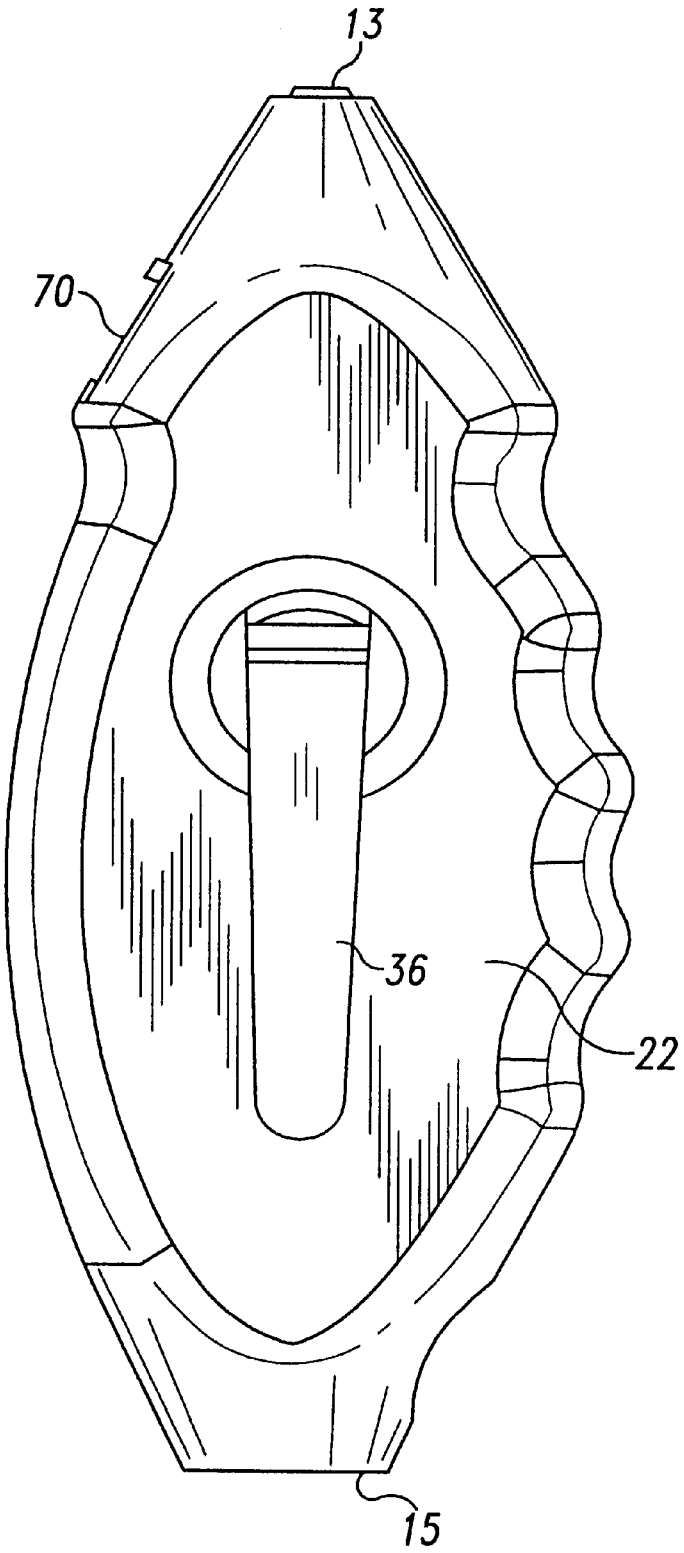
FIG. 4*c* is a top plan view of the embodiment of FIG. 1.
Figure 4D:
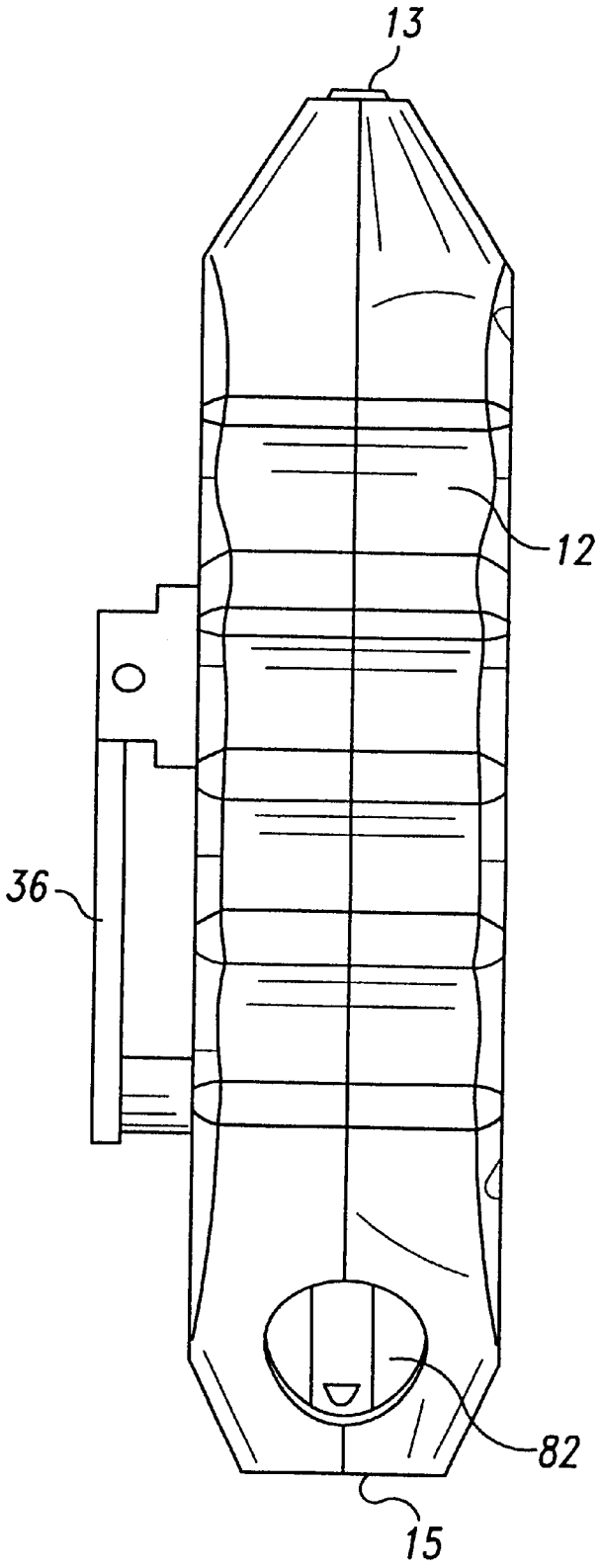
FIG. 4*d* is a side elevational view of the embodiment of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. FIGS. 1–4 illustrate one preferred embodiment of the present invention, a chalk box 10, having a housing 12 having an anterior end 13 and an anterior portion 14 and a posterior end 15 and a posterior portion 16. The anterior portion 14 further includes an anterior aperture 18 formed therein, and the posterior portion 16 includes a posterior aperture 19 formed therein. The housing 12 may be characterized in greater detail as defining a gear chamber 20, a chalk chamber 22, an anterior chamber 24, and a posterior chamber 26.

The gear chamber 20 houses a winding gear 30 and a spool-engaging gear 32. Winding gear 30 is fixedly mounted on winding shaft 34. Winding shaft 34 is rotationally mounted in gear chamber 20 and extends through the housing 12 to connect to winder 36. Winder 36 is preferably pivotally connected to winding shaft 34, such that winder 36 may be pivoted to lie flush with housing 12 when not in use and be pivoted upwardly from housing 12 for easy gripping when in use. The gear chamber 20 further includes an interior cover portion 29 adapted to isolate the gears 30, 32 from the remainder of the interior of the chalk box 10, so as to prevent chalk dust from contaminating and damaging the gears 30, 32.

Spool engaging gear 32 is fixedly mounted on spool shaft 38. Spool shaft 38 is rotationally mounted in chalk chamber 22 with a gear-engaging portion 40 extending into gear chamber 20. Spool 42 is positioned in chalk chamber 22 and is fixedly coupled to spool shaft 38. Spool 42 further includes a top disc 43 and a bottom disc 44 fixedly mounted to spool shaft 38 and spaced apart.

Chalk chamber 22 is adapted to contain a quantity of chalk dust. Gear chamber 20 is adapted to isolate gears 30, 32 from the chalk dust in chalk chamber 22. Anterior chamber 24 is in communication with chalk chamber 22 through a throat 45 defined by their junction, allowing the passage of chalk dust back and forth between the chambers 22, 24. Preferentially, anterior chamber 24 also contains a guide post 46 positioned near the throat 45, although the guidepost 46 could be positioned in the chalk chamber 22. Posterior chamber 26 is adapted to contain a pencil sharpener 48 in isolation from any chalk dust in chalk chamber 22. Anterior chamber 24 is also adapted to contain a plurality of baffles 52 formed therein between the guidepost 46 and the anterior aperture 18. The baffles 52 are substantially collinear with the guidepost 46 and the anterior aperture 18 and are provided to support a line guide tube 54. Guide tube 54 is positioned such that it extends substantially collinearly with aperture 18 and guidepost 46. It is preferred that fibrous wadding or packing 56 at least partially fill around baffles 52, supporting tube 54 and providing an additional dust seal.

A flexible line 60 is windingly coupled to spool 42 between top and bottom discs 43, 44 such that rotation of spool 42 winds flexible line 48 therearound. Flexible line 60 extends through chalk chamber 22, through throat 45, around guidepost 46 and through tube 54 to pass through anterior aperture 18. Flexible line 60 is adapted to easily pick up and deposit chalk dust. Tube 54 and the fibrous packing 56 are adapted to remove excess chalk dust from flexible line 60 as it passes therethrough, substantially preventing loose chalk dust from exiting tube 54 and allowing only that chalk dust adhering to flexible line 60 to pass through the tube 54. Preferably, tube 54 is sized to snugly hug flexible line 60 as it passes therethrough. The loose, excess chalk dust removed from flexible line 60 as it enters the tube 54 is returned to the chalk chamber 22, while the quasi-interference fit of flexible line 60 in tube 54 further discourages chalk dust leakage from chalk box 10.

Winding gear 30 is meshingly engaged with spool engaging gear 32, such that rotation of winding gear 30 actuates rotation of spool-engaging gear 32. Likewise, rotation of spool-engaging gear 32 causes rotation of the fixedly connected spool shaft 38 and spool 42. Rotation of spool 42 causes flexible line 60 to wind around the spool 42, thereby retracting flexible line 60 into chalk chamber 22. Spool shaft 38 is adapted to freely rotate, such that a worker may easily extend flexible line 60 from housing 12 by holding chalk box 10 steady and pulling on flexible line 60. Preferably, the gear ratio (the ratio of the number of teeth of one gear to the number of teeth of another gear) of the winding gear 30 to the spool-engaging gear 32 is substantially large. More preferably, the gear ratio of the winding gear 30 to the spool-engaging gear 32 is at least about 4:1.

Chalk chamber 22 also features a port 70 formed thereinto, through which chalk chamber 22 may be filled with and/or emptied of chalk dust. Flexible or rigid seal 72 may be employed to plug port 70. Preferably, seal 72 is a sliding door, although seal may be of any convenient type for preventing undesired communication of chalk dust from chalk box 10.

Posterior chamber 26 includes a pencil sharpener 48 mounted therein. Pencil sharpener 48 is adapted to be accessed by pencils through posterior aperture or orifice 19. Posterior aperture 19 is operationally aligned with pencil sharpener 48. Posterior aperture 19 is preferably partially plugged with cross-slotted flexible plug 76, which is adapted to allow the passage of a pencil therethrough while at least partially blocking the inadvertent passage of foreign objects thereinto and/or pencil shavings therefrom. Posterior chamber 26 further includes a cleanout port 80 through which accumulated pencil and/or wood shavings may be emptied. Cleanout port 80 is plugged by flexible plug 82, adapted to snugly fit therein.

Preferably, chalk box 10 is constructed from an inexpensive, lightweight structural material such as plastic (preferred), aluminum, or wood, although any convenient material may be chosen. Further, the flexible plugs are preferably formed from rubber or flexible plastic, although any convenient flexible or pliable material may be selected. Still further, the gears are preferably formed from plastic, although any convenient structural material may be chosen.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A chalk box comprising, in combination:

a elongated housing having an anterior end and a posterior end and having a gear chamber, a chalk chamber, an anterior chamber in communication with the chalk chamber and having an anterior aperture formed therein, and a posterior chamber having a posterior aperture formed therein;

a guide tube positioned within the anterior chamber and substantially collinear with the anterior aperture;

a winding gear rotationally mounted in the gear chamber;

a winder operationally coupled to the winding gear and extending through the housing;

a spool-engaging gear rotationally mounted in the gear chamber and meshingly engaging the winding gear;

a spool rotationally mounted in the chalk chamber and operationally coupled to the spool-engaging gear;

a flexible line windingly coupled to the spool and adapted to extend through the tube and out the anterior aperture;

a guide post mounted in the chalk box between the spool and the anterior aperture;

a pencil sharpener mounted in the posterior chamber; and a cross-slit flexible washer mounted in the posterior aperture;

wherein rotation of the winding gear actuates rotation of the spool-engaging gear and the spool, winding the line around the spool.

2. The chalk box of claim 1 further comprising a winding gear shaft rotationally mounted in the gear chamber and having an end portion extending through the housing, wherein the end portion is coupled to the winder.

3. The chalk box of claim 1 further comprising a spool shaft rotationally mounted in the chalk chamber and having a gear-engaging portion extending into the gear chamber, wherein the spool is coupled to the spool shaft and adapted to rotate with the spool shaft, and wherein the spool-engaging gear is coupled to the gear-engaging portion and the gear-engaging portion is adapted to rotate with the spool-engaging gear.

4. The chalk box of claim 1 wherein the winding gear has substantially more teeth than the spool-engaging gear.

5. The chalk box of claim 4 wherein the winding gear has about four times as many teeth as the spool-engaging gear.

6. The chalk box of claim 1 further comprising a port formed in the housing and adapted to establish chalk communication with the chalk chamber.

7. The chalk box of claim 6 further comprising a flexible door positioned in the port.

8. The chalk box of claim 1 wherein the guide tube is at least partially surrounded by fibrous packing material.

9. The chalk box of claim 1 further comprising:

a winding gear shaft rotationally mounted in the gear chamber and having an end portion extending through the housing;

a spool shaft rotationally mounted in the chalk chamber and having a gear-engaging portion extending into the gear chamber;

a port formed in the housing and adapted to establish chalk communication with the chalk chamber;

fibrous packing material at least partially surrounding the tube; and a flexible door positioned in the port;

wherein the end portion is coupled to the winder;

wherein the spool is coupled to the spool shaft and adapted to rotate with the spool shaft;

wherein the spool-engaging gear is coupled to the gear-engaging portion and is adapted to rotate with the spool-engaging gear; and wherein the winding gear has about four times as many teeth as the spool-engaging gear.

10. A chalk box comprising, in combination:

a housing adapted to contain a retractable flexible line in a chalk dust rich environment and having an anterior portion and a posterior portion;

an aperture formed in the anterior portion, wherein the aperture is adapted to pass the retractable flexible line;

a guide tube positioned collinear with the aperture and adapted to allow passage of the line while substantially preventing passage of loose chalk dust;

a pencil sharpener positioned in the posterior portion;

an orifice formed in the posterior portion and positioned to allow communication of a pencil with the pencil sharpener; and a partial plug positioned in the orifice and adapted to allow communication of a pencil with the pencil sharpener and further adapted to at least partially prevent the inadvertent passage of foreign objects therethrough.

11. The chalk box of claim 10 wherein the partial plug is a washer.

12. The chalk box of claim 10 wherein the washer further includes a pair of crossed slits extending therethrough.

* * * * *